US008316506B1

(12) United States Patent
Spalj

(10) Patent No.: US 8,316,506 B1
(45) Date of Patent: Nov. 27, 2012

(54) SURFACE DEBRIS REMOVAL APPARATUS

(76) Inventor: Thomas J. Spalj, Osage Beach, MO (US)

( * ) Notice: Subject to any disclaimer, the term of this patent is extended or adjusted under 35 U.S.C. 154(b) by 609 days.

(21) Appl. No.: 12/474,110

(22) Filed: May 28, 2009

Related U.S. Application Data

(60) Provisional application No. 61/056,769, filed on May 28, 2008.

(51) Int. Cl.
*A47L 5/24* (2006.01)
*A47L 5/00* (2006.01)

(52) U.S. Cl. ..... 15/344; 15/405

(58) Field of Classification Search ..... 15/344, 15/405, 329, 330, 350; 473/131, 324–350, 473/282
See application file for complete search history.

(56) References Cited

U.S. PATENT DOCUMENTS 2,972,160 A * 2/1961 Hahn ..... 15/344
3,999,243 A 12/1976 La Pour
4,237,576 A * 12/1980 Stakes ..... 15/344
4,718,140 A * 1/1988 Johnson ..... 15/330
4,884,314 A 12/1989 Miner et al.
4,945,604 A * 8/1990 Miner et al. ..... 15/344
5,332,222 A 7/1994 Perry
6,039,062 A 3/2000 Karakaedos
6,141,824 A * 11/2000 Fujiwara et al. ..... 15/330
6,345,411 B1 * 2/2002 Kato et al. ..... 15/412
6,817,059 B2 * 11/2004 Tsuchiya et al. ..... 15/352
6,834,413 B2 12/2004 Sanders et al.
D529,243 S 9/2006 Noma et al.
7,398,579 B2 * 7/2008 Moshenrose ..... 16/430
7,845,048 B1 * 12/2010 Bailey et al. ..... 15/405
D643,892 S * 8/2011 McGrorty ..... D21/735
2009/0056060 A1 * 3/2009 Han et al. ..... 15/349

* cited by examiner

*Primary Examiner* — Bryan R Muller

(57) ABSTRACT

An apparatus for directing airflow for moving debris across a surface is provided. The apparatus includes a shaft, and a golf club head coupled to the shaft at an end opposite the grip. The club head includes a blower assembly within the club head, the blower selectively operable to direct airflow through the club head along a central axis from the club head heel out the club head toe, to move debris to a desired location. Optional embodiments provide varied club head shapes and attachments, and a flashlight removably disposed within the grip, with automatic operation upon removal of the grip from the shaft.

7 Claims, 7 Drawing Sheets

SURFACE DEBRIS REMOVAL APPARATUS

I claim benefit of my U.S. Provisional Application No. 61/056,769 filed on May 28, 2008.

BACKGROUND OF THE INVENTION

In golf, it is not uncommon for leaves, dirt, debris and other foreign matter to lie in various areas of a golf course and hinder a golfer's ability to putt a ball. Debris in the path of a ball can easily alter the course and speed of a ball putted towards a hole. To prevent foreign matter from undesirably altering the path of a ball they intend to putt, golfers typically need to bend over and manually remove debris from the putting surface. However, when there are large amounts of debris, such as may occur during the fall or during windy conditions, it may take a significant amount of time to clear the putting path. Further, over time, frequent bending to remove debris from a putting surface may fatigue the golfer, cause injury to the golfer's back, or aggravate an existing back condition.

Some products have been developed to remove debris from a putting surface. For example, grounds keepers often remove debris frequently during the day with a leaf blower. However, labor is generally expensive. And, a grounds keeper cannot always be handy when a golfer wishes. Further, a golfer is not inclined to carry a typical leaf blower in a golf bag. Regarding the use of a club itself to remove debris from a putting surface, it has been experimentally determined that more than one factor is required in the successful design of such a club. First, it is most desirable that the device be electrically operated, instead of having any sort of compressed canister for air supply, as extended operation from compressed gas canisters is not possible.

It has further been determined that air movement devices, such as fans, should be located within the club head itself, in order to negate air flow and pressure loss, as compared to designs that locate air movement devices within a grip of shaft of the club. Additionally, blowing air from a clubface is undesirable, as ball impact can be effected.

FIELD OF THE INVENTION

The surface debris removal apparatus relates generally to golf clubs and more specifically to a golf club further comprising a surface debris removal feature.

SUMMARY OF THE INVENTION

The general purpose of the surface debris removal apparatus, described subsequently in greater detail, is to provide a surface debris removal apparatus that has many novel features that result in an improved surface debris removal apparatus that is not anticipated, rendered obvious, suggested, or even implied by prior art, either alone or in combination thereof.

To attain this, the apparatus is provided in more than one embodiment. The apparatus includes a grip coupled to the shaft and a club head coupled to an opposite end of the shaft. The most complete embodiment provides a removable flashlight within the grip. The flashlight turns on automatically when detached from the shaft. All embodiments provide a selectively operated blower assembly within the club head.

Locating the blower assembly within the club head itself prevents air flow and air velocity loss as compared to positioning the air blower assembly within the shaft or the grip. Air is drawn into the club head by more than one blower assembly embodiment. All embodiments blow air out of the club head to propel debris out of the intended pathway of the golf ball. Fan embodiments include a squirrel cage fan and an axial fan. Various club head designs are provided, with each accomplishing the desired debris removal task. Fan operation is selectively engaged via the activation device that is preferably an on/off switch disposed in the shaft proximal to the grip. The power source for the apparatus can be provided in the grip, in the club head, or in both.

Thus has been broadly outlined the more important features of the improved surface debris removal apparatus so that the detailed description thereof that follows may be better understood and in order that the present contribution to the art may be better appreciated.

An object of the surface debris removal apparatus is to clear debris from a surface.

An object of the surface debris removal apparatus is to clear debris from a surface without a user having to bend.

Another object of the surface debris removal apparatus is to clear debris from a surface without manual effort.

Yet another object of the surface debris removal apparatus is to provide a blower assembly within the club head.

A further object of the surface debris removal apparatus is to provide various club head shapes and sizes.

Yet another object of the surface debris removal apparatus is to increase the pressure of air that moves through the club head.

Still another object of the surface debris removal apparatus is to provide a detachable flashlight.

And, an object of the surface debris removal apparatus is to provide automatic flashlight activation with removal of the flashlight from the shaft.

These together with additional objects, features and advantages of the improved surface debris removal apparatus will be readily apparent to those of ordinary skill in the art upon reading the following detailed description of presently preferred, but nonetheless illustrative, embodiments of the improved surface debris removal apparatus when taken in conjunction with the accompanying drawings.

In this respect, before explaining the current embodiments of the improved in detail, it is to be understood that the surface debris removal apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved surface debris removal apparatus. It is therefore important that the claims be regarded as including such equivalent constructions insofar as they do not depart from the spirit and scope of the surface debris removal apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 10 thereof, the principles and concepts of the surface debris removal apparatus generally designated by the reference number 10 will be described.

Figure 1:
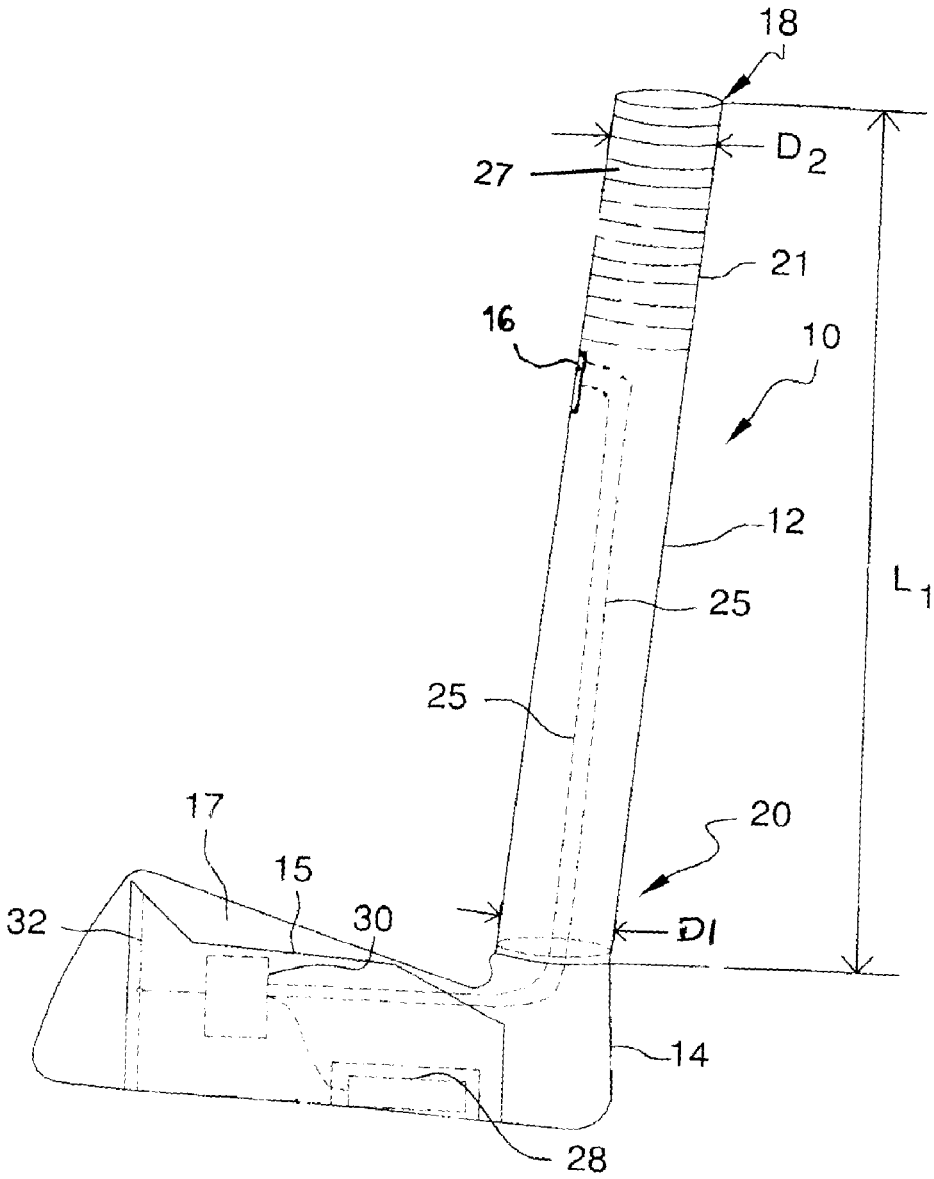
FIG. 1 is a lateral elevation view illustrating one embodiment of the club head.

FIG. 1 is a side elevation view of an exemplary debris removal apparatus 10. In the exemplary embodiment, apparatus 10 is shaped substantially similar to a typical golf club (not shown).

Figure 2:
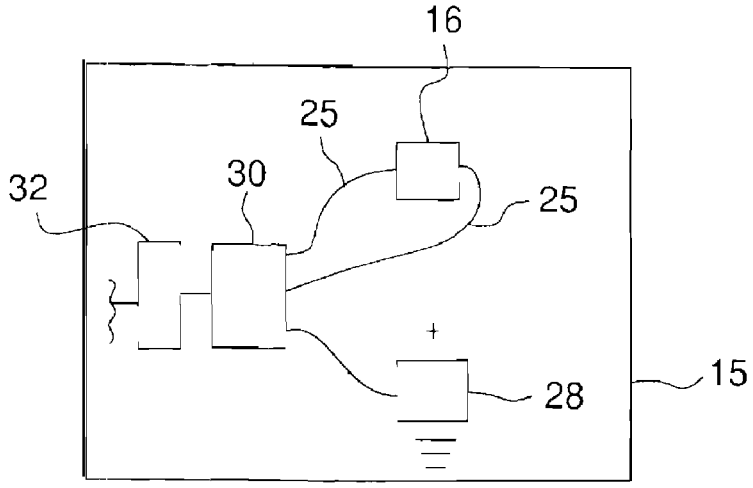
FIG. 2 is a schematic block diagram of an exemplary blower assembly that may be used within the apparatus.

The apparatus 10 includes a shaft 12, a golf club head 14, and an activating device 16 within the shaft 12. In the exemplary embodiment, golf club head 14 is coupled to shaft 12 at the base end 20. In the exemplary embodiment, apparatus 10 is fabricated from a metallic material. In an alternative embodiment, apparatus 10 is fabricated from non-metallic materials, such as, but not limited to plastic materials and composites. In a further alternative embodiment, apparatus 10 is fabricated from a combination of known materials. Shaft 12 extends from a handle end 18 to base end 20. The ideal shaft 12 is hollow and tapers slightly from handle end 18 on the grip 21 towards base end 20, such that base end 20 has a smaller base end diameter D1 than the handle diameter D2 of handle end 18. In an alternate embodiment diameters D1 and D2 are approximately equal. The shaft 12 has a length L1 that varies in various embodiments. As such, apparatus 10 may be conveniently and discretely carried in a golf club bag with other golf clubs. The shaft 12 also includes a grip 21 at handle end 18. The grip 21 has a plurality of ridges 27 disposed along the entire length thereof FIG. 2 is a schematic illustration of an exemplary blower assembly 15 that may be used with debris removal apparatus 10. The activation device 16 is operable to selectively control activation of blower assembly 15. For example, device 16 may be, but is not limited to being, an electrical starter. Activation device 16 is ideally an on/off switch. The activation device 16 is disposed within the shaft 12 adjacent to grip 21 and proximal to handle end 18. The activation device 16 is electrically coupled to blower assembly 15 via wires 25 through the hollow shaft 12.

Figure 3:
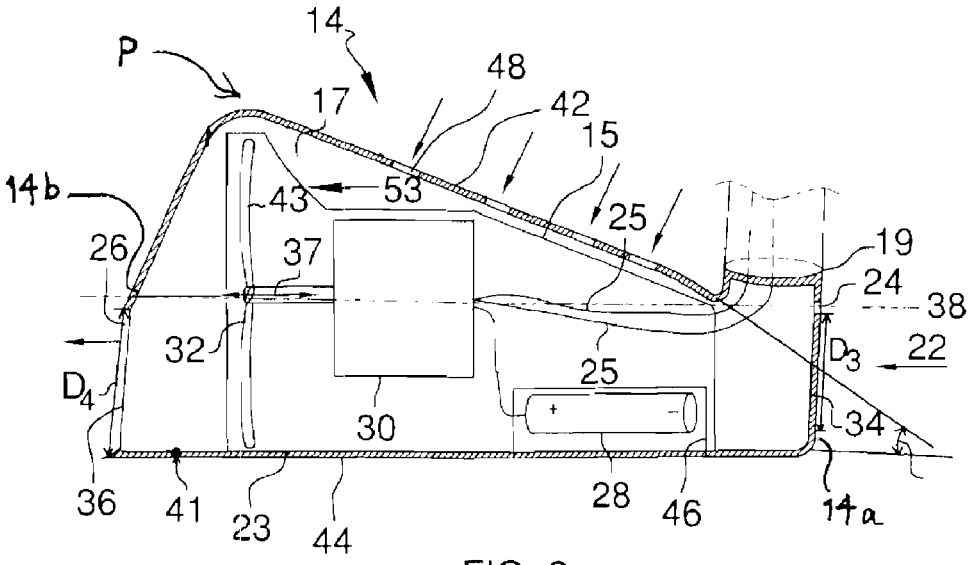
FIG. 3 is a cross sectional view of the club head of FIG. 1.

Referring to FIGS. 2 and 3, club head body 23 includes a cavity 17 defined therein that is sized to receive blower assembly 15 therein. The blower assembly 15 includes a power source 28, a motor 30, and an air moving device 32 housed within cavity 17. The air moving device 32 is operatively coupled within cavity 17 such that motor 30 and air moving device 32 are substantially concentrically aligned along central axis 38. Alternatively, motor 30 and air moving device 32 may be oriented with any relative position that enables blower assembly 15 to function as described herein. In the exemplary embodiment, power source 28 is a battery, and air moving device 32 is a fan. Specifically, power source 28 is a 9 volt battery, motor 30 is a 9-18 volt direct current motor, and air moving device 32 is a 12 volt direct current micro fan, for example. Alternatively, power source 28 may be any power source that enables motor 30 and blower assembly 15 to function as described herein. Referring again to FIG. 3, the air moving device 32 includes a plurality of blades 43 that rotate about an axis of rotation 37. The rotation of blades 43 causes air movement through passage 22. The axis of rotation 37 and central axis 38 of passage 22 are substantially aligned. The blower assembly 15 may include the housing 46 that is sized to encase power source 28. Housing 46 is coupled to the bottom edge 44. The bottom edge 44 includes a hinge 41 that enables a portion of bottom edge 44 to be hingedly coupled to the remainder of bottom edge 44 to provide access to power source 28. The power source 28 is removably coupled within housing 46. Referring to FIG. 3, inlet 24 includes the first opening 34 defined by inlet diameter D3. Outlet 26 includes the second opening 36 defined by the outlet diameter D4.

Figure 4:
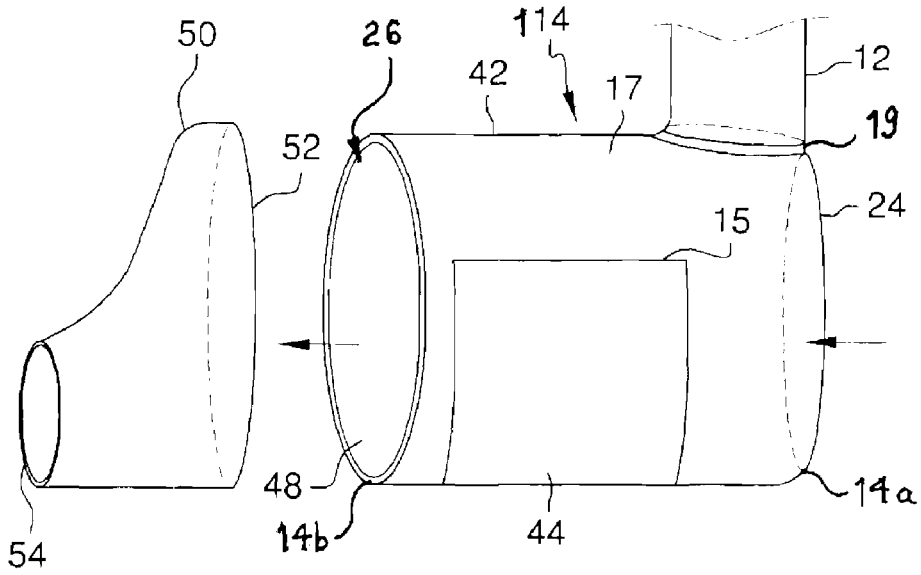
FIG. 4 is a lateral elevation view of the alternative club head.

In the exemplary embodiment, the inlet diameter D3 is sized differently than outlet diameter D4. Alternatively, as shown in FIG. 4, inlet diameter D3 is sized approximately the same as outlet diameter D4. In a further alternative embodiment, inlet diameter D3 is smaller than outlet diameter D4. In yet another alternative embodiment, inlet 24 and outlet 26 may be formed with any number of openings that enable club head 14 to function as described herein. In the exemplary embodiment, inlet 24 is oriented at the heel 14*a* of body 23. Outlet 26 is located at the toe 14*b* of body 23.

As shown in FIG. 3, body 23 also includes a top edge 42, and an opposite bottom edge 44. The bottom edge 44 is substantially planar, and top edge 42 is oriented at an angle P with respect to bottom edge 44. In an alternative embodiment illustrated in FIG. 4, club head 14 is substantially tubular such that top edge 42 is substantially parallel with respect to bottom edge 44. Further, top edge 42 and bottom edge 44 may be at any relative orientation that enables head 14 to function as described herein. The top edge 42 includes openings 48 defined therein. Openings 48 enable additional air to enter passage 22. In the exemplary embodiment, air channeled through passage 22 flows substantially parallel to central axis 38. Alternatively, air channeled through passage 22 flows substantially perpendicular to central axis 38. In another alternative embodiment, air entering passage 22 flows through passage 22 obliquely with respect to central axis 38.

Figure 5:
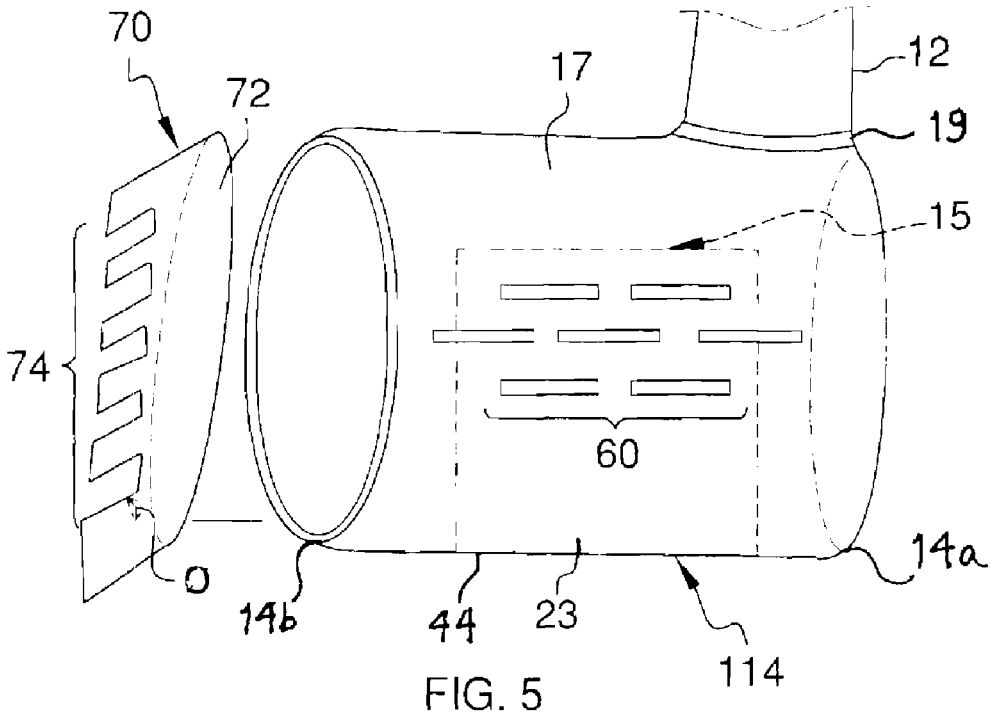
FIG. 5 is a lateral elevation view of the alternative club head, with optional features.
Figure 6:
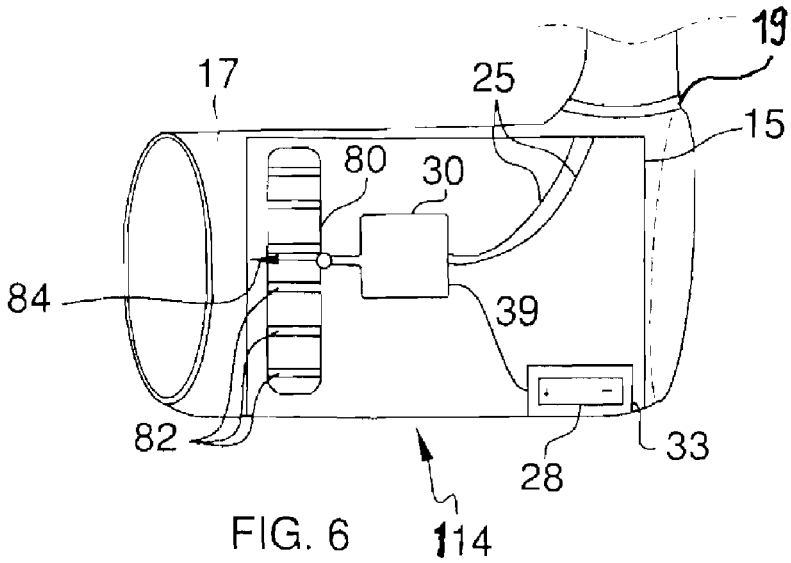
FIG. 6 is a partial cross sectional view of FIGS. 4 and 5.

Referring to the alternate embodiments of FIGS. 4, 5, and 6, the housing 46 and power source 28 are accessible through inlet 24 of alternate club head 114. FIG. 4 is a perspective view of an alternative embodiment club head denoted 114 may be used with debris removal apparatus 10. Like FIG. 3, alternative club head 114 also includes a club head body 23 and a shank 19 extending from body 23. The shank 19 extends from body 23 and is configured to couple to shaft base end 20. Club head 14 includes the passage 22 defined therein that extends between inlet 24 and outlet 26.

In the embodiment illustrated in FIG. 4, the debris removal apparatus 10 also includes an attachment member 50 that is coupled to club head 114 adjacent to outlet 26 disposed at the toe 14*b*. Attachment member 50 further directs air away from club head 114. In this club head 114 embodiment, attachment member 50 includes two openings comprising the first opening 52 and the second opening 54. The first opening 52 is larger than second opening 54. In an alternative embodiment (not shown), the first opening 52 is smaller than or approximately the same size as the second opening 54.

Referring to FIGS. 1, 2, 3 and 7, to selectively operate the blower assembly 15, a user triggers activating device 16. The activating device 16 initiates motor 30 that is energized by power source 28. Motor 30 in turn initiates air moving device 32. Once air moving device 32 is initiated, air is drawn through passage 22 at heel 14*a*. Specifically, air is channeled through inlet 24 in an axial direction 53 towards outlet 26 at toe 14*b* by the rotation of blades 43. The rotation of blades 43 facilitates pressure increase of the airflow such that air exiting passage 22 is at a higher pressure than the air entering passage 22. The high pressure airflow facilitates moving debris across a surface to a desired location.

During operation of the apparatus 10 blower assembly 15 shown in FIG. 3, an amount of airflow may be channeled through openings 48 into passage 22 in addition to the airflow flowing through passage 22 from inlet 24 to outlet 26.

During operation of the alternate embodiment of the apparatus 10 illustrated in FIG. 4, the attachment member 50 facilitates channeling the airflow exiting passage 22 outward from club head 214. Airflow exiting outlet 26 is channeled through attachment member 50 from inlet 52 towards outlet 54. The shape of attachment member 50 facilitates increasing the speed of the airflow exiting inlet 24.

Referring to FIGS. 4 and 5, the alternative club head 114 may be used with debris removal apparatus 10. Alternative club head 114 includes blower assembly 15. In contrast to body 23 of FIG. 3, club head 114 of FIG. 5 includes a plurality of opening slits 60, and openings 48 are negated. Opening slits 60 provide additional air into passage 22. In the exemplary embodiment, opening slits 60 each have a substantially rectangular and cross-sectional shape, and enable air to flow substantially parallel to central axis 38. In an alternative embodiment, air flows substantially perpendicular to central axis 38. In an additional alternative embodiment, the air flows obliquely with respect to central axis 38. Alternatively, opening slits 60 have non-rectangular cross-sectional shapes.

Further illustrated in FIG. 5, the apparatus 10 also includes the alternate attachment member 70 coupled to club head 114 proximate outlet 26. Alternate attachment member 70 is similar to attachment member 50. Alternate attachment member 70 is coupled to club head 114 adjacent outlet 26.

In contrast to attachment member 50, the alternate attachment member 70 includes a central passage 72 and a plurality of discharge openings 74 to direct air away from club head 114. Discharge openings 74 are similar to louvers and are oriented at an opening angle O with respect to the bottom edge 44. In an alternative embodiment, discharge openings 74 are substantially parallel to bottom edge 44. Operation of apparatus 10 including club head 114 is substantially similar to operation of apparatus 10 including club head 14. However, rather than an amount of airflow being channeled through openings 48 into passage 22, an amount of airflow is channeled through opening slit 60 into passage 22.

During operation of apparatus 10 illustrated in FIG. 5, attachment member 70 facilitates channeling the airflow exiting passage 22 outward from club head 114. Airflow exiting outlet 26 is channeled through alternate attachment member 70 from central passage 72 discharge openings 74.

Referring to FIGS. 4, 5, and more specifically FIG. 6, the alternative club head 114 may be used with the debris removal apparatus 10. In the embodiment illustrated in FIG. 6, the inlet diameters D3 and outlet diameter D4 of club head 114 are substantially the same. In contrast to body 23 of club head 14, body 23 of alternate club head 114 does not include openings 48 and does not include attachment member 50. In contrast to blower assembly 15 of club head 14, blower assembly 15 of club head 114 does not include air moving device 32 but instead includes the alternate air moving device 80. The alternate air moving device 80 is a squirrel cage fan assembly that includes a plurality of blades 82 that rotate about the alternate axis of rotation 84. Operation of apparatus 10 including club head 114 is substantially similar to operation of apparatus 10 including club head 14. However, in contrast to air moving device 32 providing an axial flow, alternate air moving device 80 provides a cross-flow (i.e. a tangential flow) with respect to the alternate axis of rotation 84.

Figure 7:
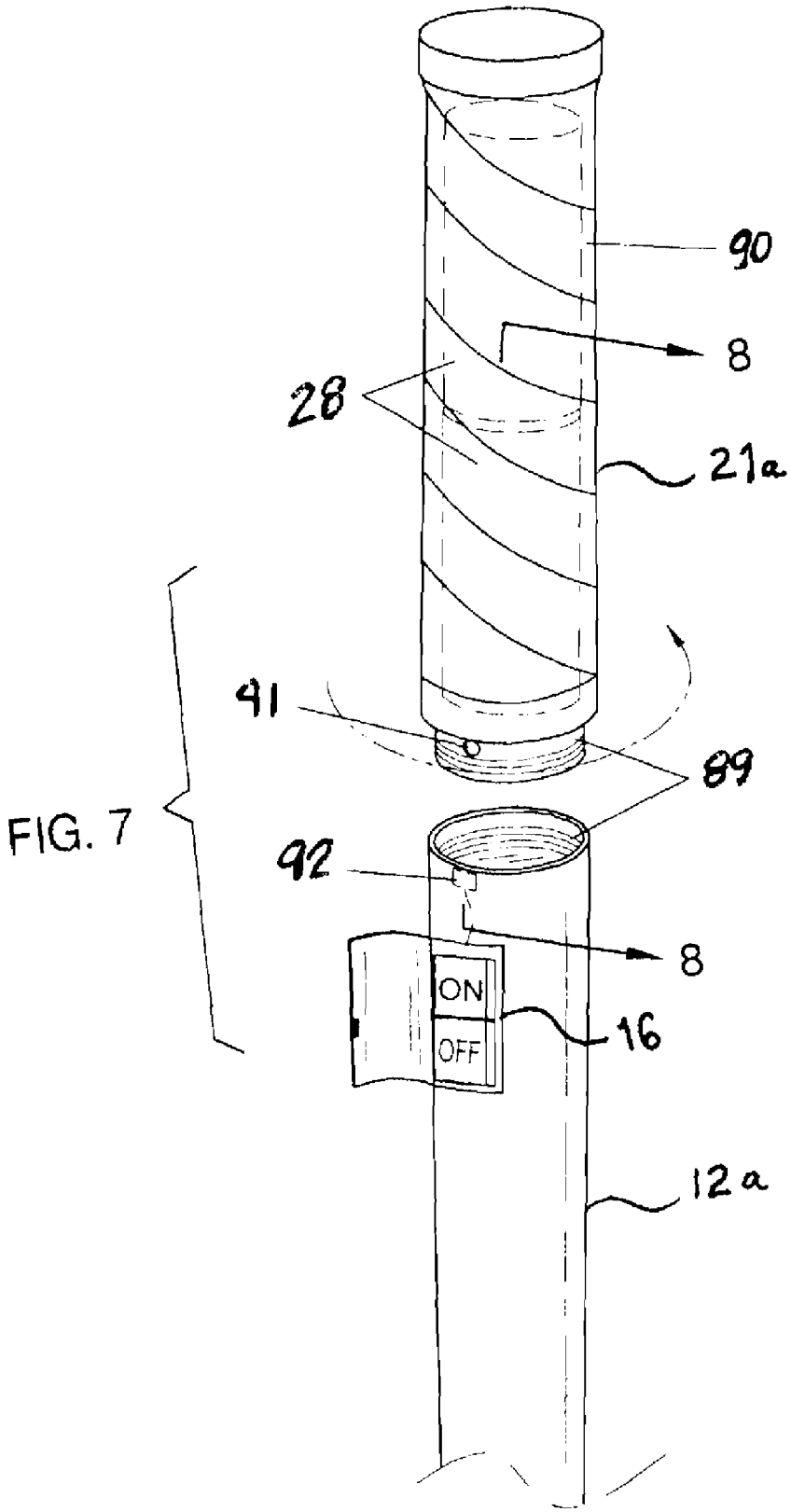
FIG. 7 is a perspective view of an alternate grip embodiment comprising a removable flashlight.
Figure 8:
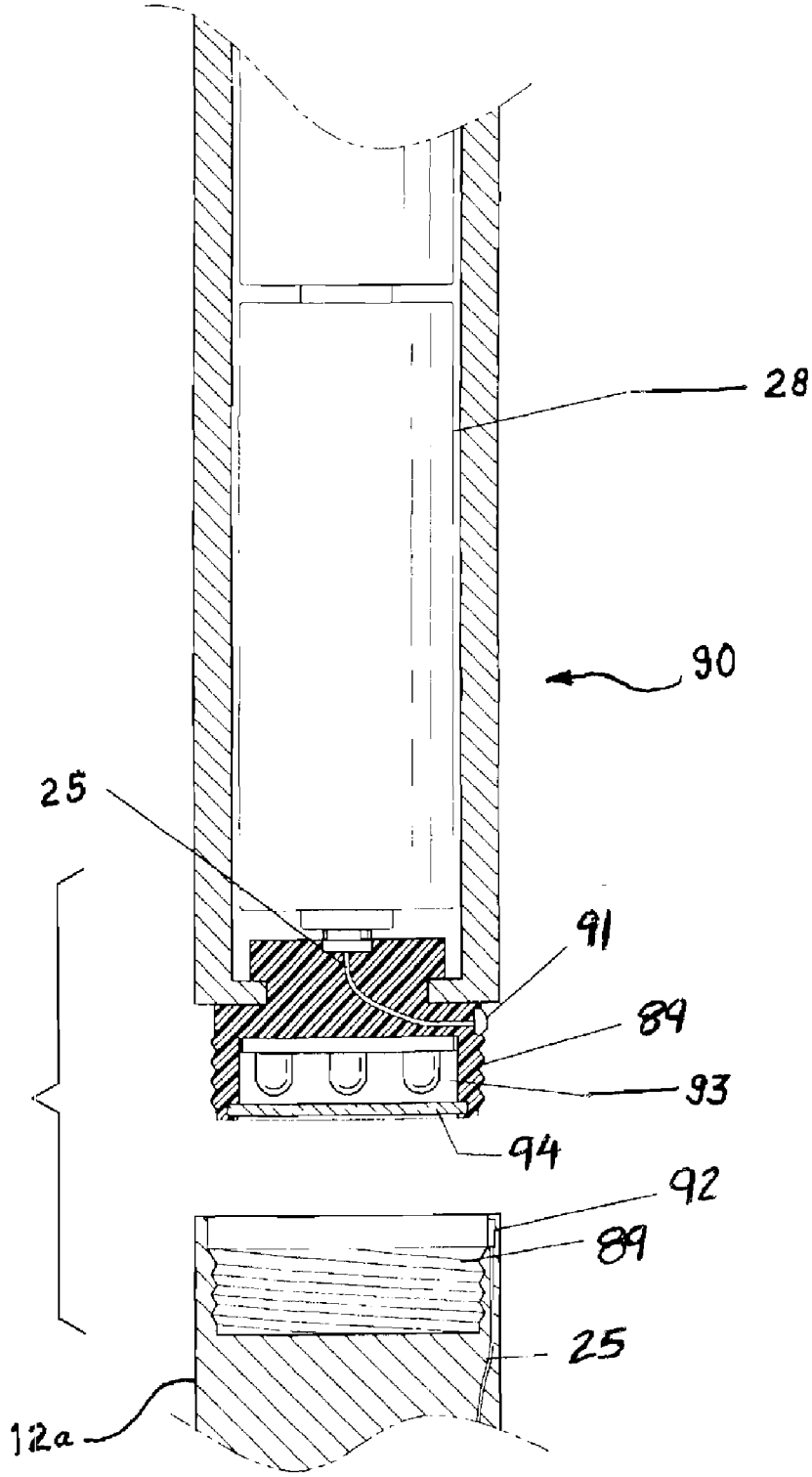
FIG. 8 is a cross sectional view of FIG. 7, taken along the line 8-8.

Referring to the apparatus 10 of FIGS. 7 and 8, the alternate grip 21*a* features a flashlight 90 threadably coupled to the alternate shaft 12*a* via the threaded coupling 89. The grip is disposed at the handle end 18. The alternate shaft 12*a* base end 20 is spaced apart from the threaded coupling 89. The contact 92 is disposed on the alternate shaft 12*a* at the threaded coupling 89. The contact bump 91 is disposed within the grip 21 at the threaded coupling 89. The lens 94 is disposed within the grip 21 at the threaded coupling 89. The plurality of LED's (light emitting diodes) 93 is disposed behind the lens 94. While two batteries 28 provide a power source separate from the power source of the blower assembly 15, one battery 28 may also be used. Batteries 28 are in communication with the contact bump 91 and the LED's 93. The LED's 93 are automatically powered upon the release of contact between the contact 92 and the contact bump 91.

Figure 9:
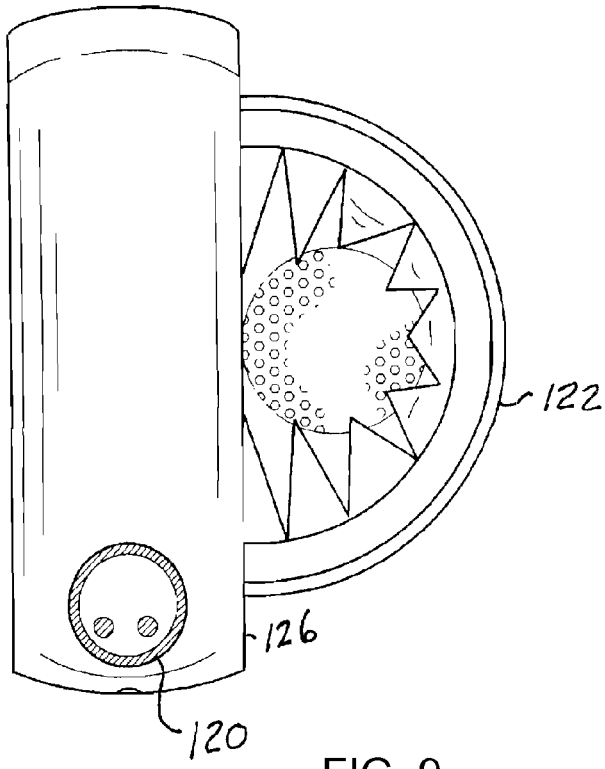
FIG. 9 is a bottom plan view of a divot repair tool and ball retrieval mechanism embodiment.
Figure 10:
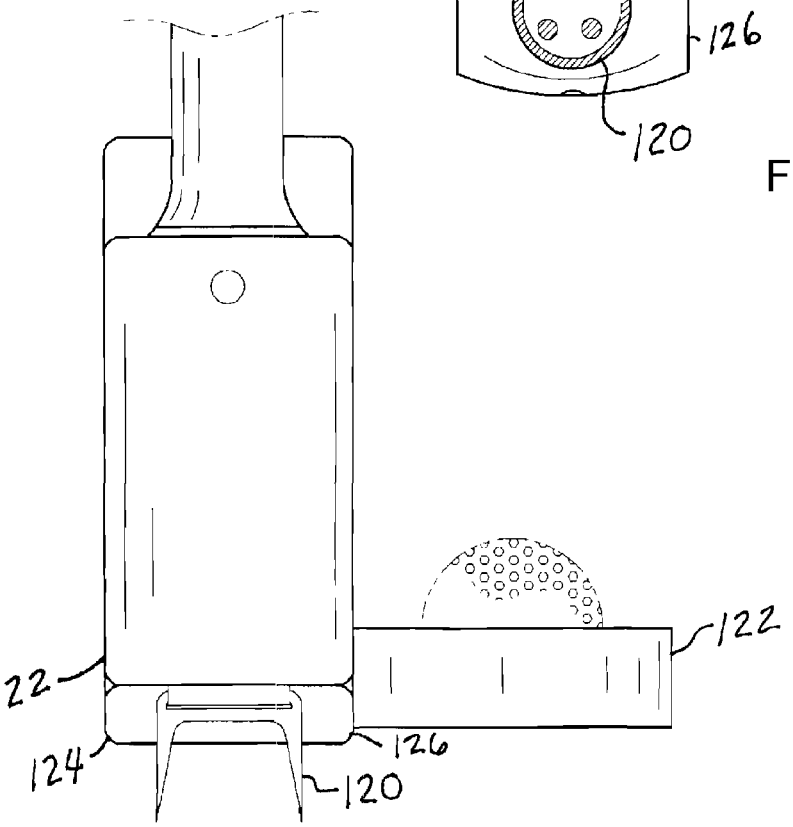
FIG. 10 is a side elevational view of the embodiment show in FIG. 9.

Another embodiment of the apparatus 10, shown in FIGS. 9 and 10, further adds a divot repair tool 120 and ball retrieval mechanism 122. The divot repair tool is pivotally attached to a lower side 124 of the club head 22. The ball retrieval mechanism 122 is attached to a rear side 126 of the club head 22.

The above-described debris removal apparatus 10 facilitates directing airflow for moving debris across a surface to a desired position. Specifically, the device facilitates increasing air flow through the body of the club head. The debris removal apparatus 10 aids a golfer in his golf game. The apparatus 10 facilitates preventing undesirable debris from altering the path of the golf ball. And, the apparatus 10 prevents golfers from having to bend over and manually remove debris from the putting surface.

As such, the apparatus 10 reduces the time it takes to clear a putting surface of debris and reduces any fatigue that the golfer may experience by frequently bending over. Additionally, the above-described apparatus 10 provides an inexpensive debris removal option that easily, conveniently, and discretely fits within a golfer's golf bag.

With respect to the above description then, it is to be realized that the optimum dimensional relationships for the parts of the surface debris removal apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the surface debris removal apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the surface debris removal apparatus may be used.

Therefore, the foregoing is considered as illustrative only of the principles of the surface debris removal apparatus. Further, since numerous modifications and changes will readily occur to those skilled in the art, it is not desired to limit the surface debris removal apparatus to the exact construction and operation shown and described, and accordingly, all suitable modifications and equivalents may be resorted to, falling within the scope of the surface debris removal apparatus.

What is claimed is:

1. An apparatus for directing airflow for moving debris across a surface, the apparatus comprising:

a hollow shaft having a grip disposed at a handle end thereof and a base end spaced opposite from the grip;

a club head coupled to the shaft via a shank at the base end, the club head having a heel spaced apart from a toe, the toe having a greater height than a height of the heel, a cavity disposed between the heel and the toe and a top edge spaced apart from a bottom edge, wherein the shank is directly connected to the heel and the top edge comprises a plurality of spaced apart openings in communication with the cavity;

an inlet disposed in the heel;

an outlet disposed in the toe;

a central axis disposed from the heel to the toe;

a blower assembly disposed within the club head cavity, the blower assembly drawing air into the inlet and forcing air out of the outlet;

a power source for the blower assembly;

an activation device selectively operating the blower assembly.

2. The apparatus according to claim 1 wherein the shaft further comprises a taper from the handle end to the base end.

3. The apparatus according to claim 2 wherein the power source is at least a one battery.

4. The apparatus according to claim 3 wherein the at least one battery is disposed within the golf club head.

5. The apparatus according to claim 4 wherein the golf club head is tapered from the toe to the heel, and wherein, the top edge is positioned at an angle to the bottom edge, the top edge extended from the shank to the toe.

6. The apparatus according to claim 5 wherein the bottom edge further comprises a hinge enabling a portion of the bottom edge to be hingedly coupled to a remainder of bottom edge.

7. The apparatus according to claim 6 wherein the inlet further comprises an inlet diameter, the outlet further comprises an outlet diameter, the inlet diameter less than the outlet diameter.

* * * * *